US005140714A

United States Patent [19]

Horenstein et al.

[11] Patent Number: 5,140,714

[45] Date of Patent: Aug. 25, 1992

[54] SHOWER WATER SAVER

[76] Inventors: Aureen A. Horenstein, 16908 Bosque Dr., Encino, Calif. 91436; Stewart R. Tongret; Inez E. Tongret, both of 1251 14th St., Santa Monica, Calif. 90404; June M. Adler, 6000 Reims, #4403, Houston, Tex. 77036

[21] Appl. No.: 770,620

[22] Filed: Oct. 3, 1991

[51] Int. Cl.[5] ..... A47K 4/00

[52] U.S. Cl. ..... 4/597; 4/596

[58] Field of Search ..... 4/144.1, 597, 605, 609, 4/661, 665, 144.2, 144.3, 144.4; 141/114, 263, 271, 281, 250, 313, 314, 331, 332, 333, 334, 337, 338, 374, 379, 388; 604/349, 351, 353

[56] References Cited

U.S. PATENT DOCUMENTS 3,162,193 12/1964 Zacks ..... 4/597
4,245,666 1/1981 Norris ..... 141/337
4,856,568 8/1989 Murphy et al. ..... 141/337

*Primary Examiner*—Henry J. Recla
*Assistant Examiner*—Thomas Sweet

[57] ABSTRACT

A device for saving water ordinarily wasted while waiting for the hot water to come from the hot water tank prior to showering. The device consists of an elongated flexible and collapsible tube (16) of waterproof material. The tube (16) has a cuff (14) at the top and a cover (18) at the bottom. A fastening (12) attaches the cuff (14) to a shower arm (20). The cuff (14) can remain around the showerhead (22) directing water through tube (16) to the container (24) or can easily be removed from the showerhead (22) to allow user to shower. Tube (16) is sufficiently large in diameter so hydrodynamic resistance will not put undue pressure on fastening (12). Tube (16) extends through a hole in the cover (18) extending somewhat below cover (18). The cover (18) protects water accumulated in a container (24) from soap, shampoo and/or bodily contaminants.

5 Claims, 4 Drawing Sheets

SHOWER WATER SAVER

BACKGROUND

1. Field of Invention

This invention relates to water-saving devices for residence bathroom shower; specifically to a device for saving the cool water from the hot water tap ordinarily wasted while waiting for the hot water to come from the hot water tank prior to showering.

2. Discussion of Prior Art

California is in the midst of a severe water shortage. According to the Los Angeles Department of Water and Power, typical water use for a single family detached home, with three occupants, is about 150,000 gallons per year. 15 percent is for bathing (mainly showers). Generally, when determining the location of the hot water tank for the household hot water supply, location of the highest consumption is considered. The location is normally close to the kitchen since this is often the area of highest comsumption in the average home. It is common practice for most persons to turn on the hot side of the shower valve and let it run until the hot water comes from the hot water tank. Often the hot water tank can be quite a distance from the user and this practice can waste quite a quantity of water. Regulation shower heads use 6–8 gallons per minute.

(a) Literature from the Metropolitan Water District of Southern California suggests that while waiting for hot water to come down the pipes, one should catch the cool water in a bucket or watering can. While this practice may be effective while running water from a tap, it is quite ineffective when trying to catch water from a shower head. Most of the water from a shower head misses a bucket placed on the floor of the shower.

(b) It is possible to use a hand shower with a long hose by placing the showerhead in a bucket placed on the floor. This solution necessitates unscrewing the regular shower head and screwing the hand shower into the shower arm. This is impractical and inconvenient if one prefers using a regular showerhead.

(c) Catching the water in a bucket on the floor allows the water to be contaminated with soapsuds, shampoo and/or bodily contaminants during the showering period. The contaminants limit the uses for which the water can be used.

(d) Solutions such as adding an extra hot water tank or installing a return loop on the distribution line which runs from the last faucet to the hot water heater are expensive.

OBJECTS AND ADVANTAGES

Accordingly, several objects and advantages of my invention are:

(a) to provide a device for saving the water from the hot water tap ordinarily wasted while waiting for the hot water to come from the hot water tank prior to showering;

(b) to provide a water-saving device that can easily be placed on and removed from different sizes of shower heads;

(c) to provide a device that protects from impurities water saved by this invention prior to showering;

(d) to provide a water saving device of a simple design and inexpensive materials that can be manufactured inexpensively.

Further objects and advantages are to provide a water saving device which can easily be stored in the shower when not in use; to provide a device which can be rolled up into a compact and light package for transporting; to provide a device which can show how much water is being saved through its transparent tube and cover; to provide a device which will allow the bather to stand in the shower compartment without being sprayed with either too cold or too hot water while making adjustment for a comfortable water temperature; and to provide a device which allows the bather to determine the water heat through the tube by feeling the exterior of the tube.

DRAWING FIGURES

REFERENCE NUMERALS IN DRAWINGS

12—fastening
14—cuff
16—tube
18—cover
20—shower arm
22—showerhead
24—container

DESCRIPTION

Figure 1:
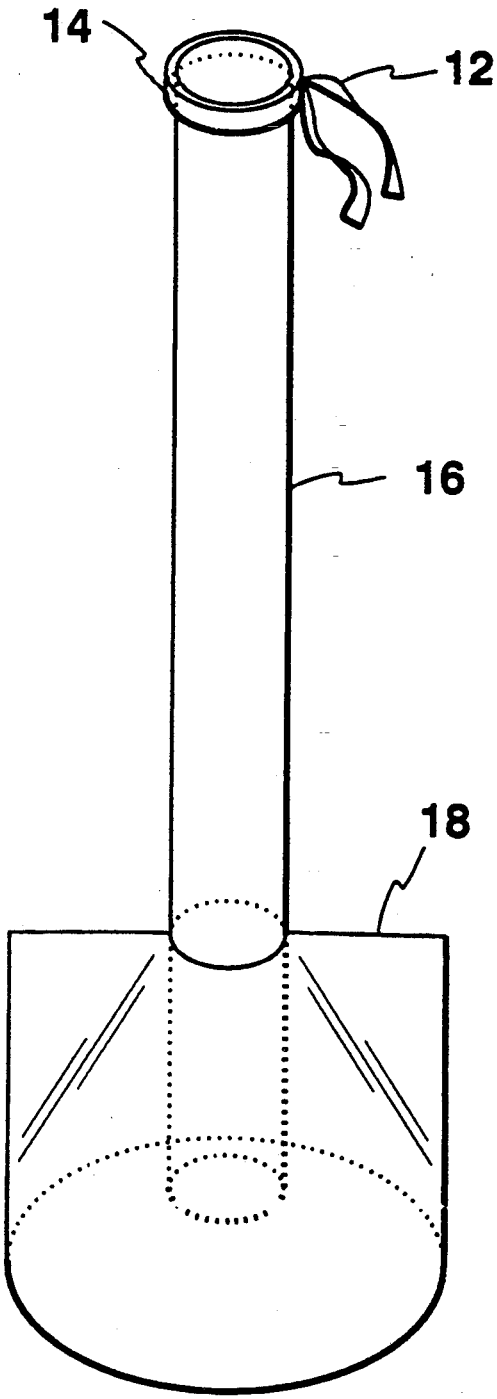
FIG. 1 is an isometric view of the invention.
Figure 2:
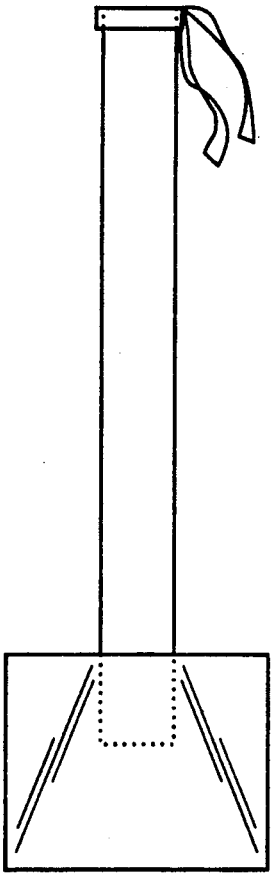
FIG. 2 is a side view of the invention.
Figure 3:
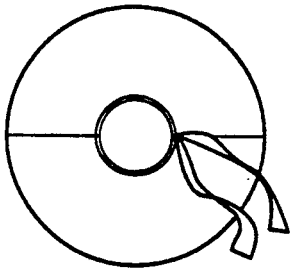
FIG. 3 is a top view of the invention.
Figure 4:
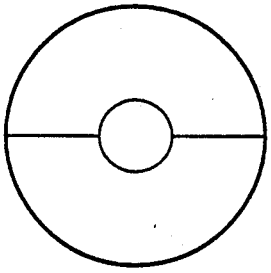
FIG. 4 is a bottom view of the invention.
Figure 5:
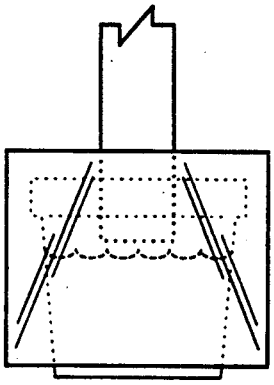
FIG. 5 is a detail of the cover over a container containing water.
Figure 6:
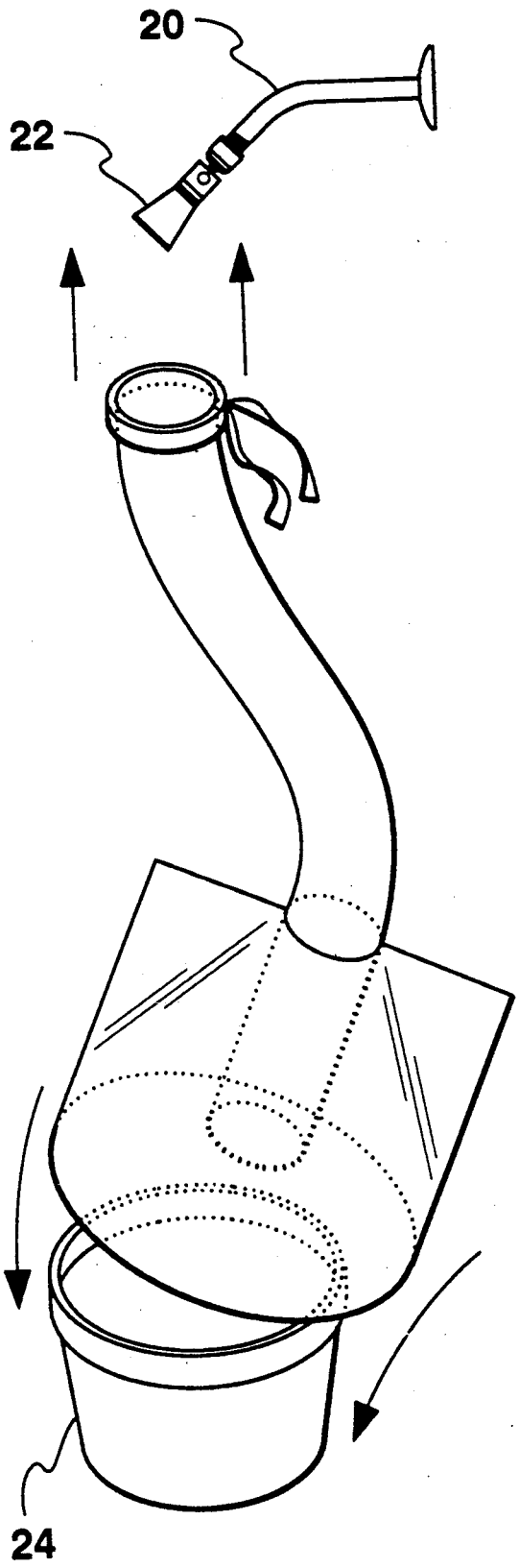
FIG. 6 is an isometric view of the invention with the upper end ready to be attached to the shower arm and the cover at the bottom of the invention ready to be placed over container.
Figure 7:
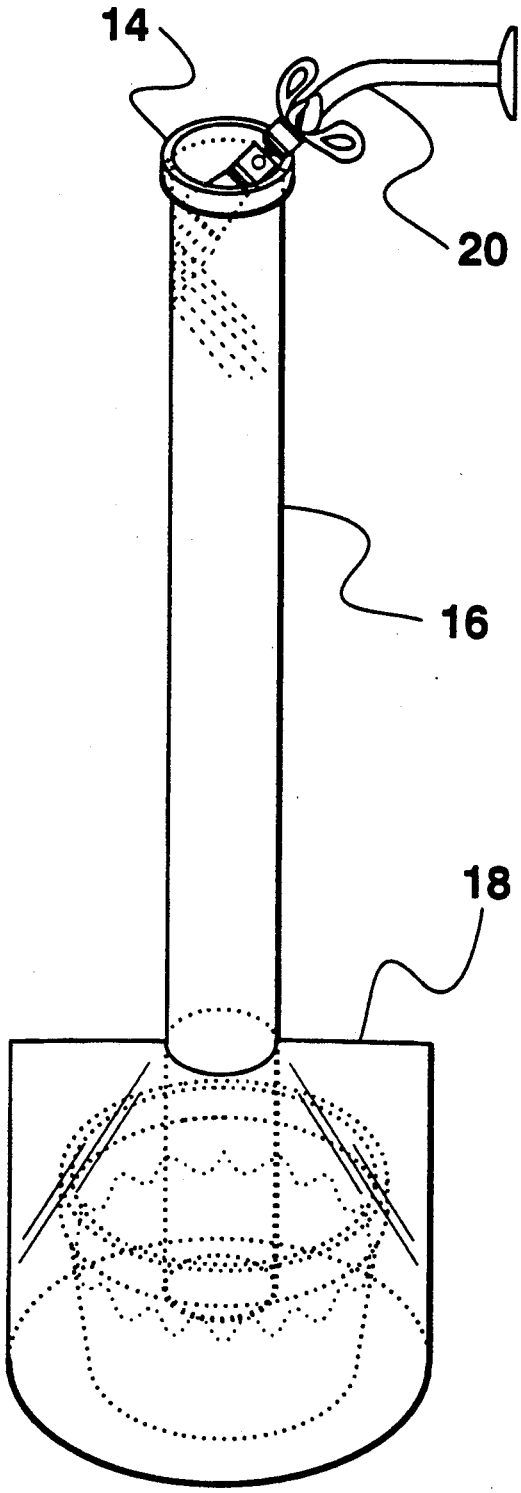
FIG. 7 is an isometric view of the invention showing cuff in a position surrounding and encasing the showerhead and extending to a level above the water discharging from the showerhead. Water is directed into container.

Isometric view of invention is illustrated in FIG. 1. Top edge of a tube 16 is folded over to form a cuff 14 approximately 8 centimeters wide. A fastening 12 extends from top of cuff 14 and attaches cuff 14 to a shower arm 20 as shown in FIG. 7. Fastening 12 consists of two plastic ties, approximately 20 centimeters long, heatsealed to cuff 14 which can be tied to shower arm 20 (FIGS. 6 and 7). Tube 16 is approximately 172 centimeters long and 35 centimeters in circumference. Tube 16 drops through hole in middle of cover 18 extending approximately 20 centimeters below cover 18. Tube 16 and cover 18 are heatsealed on the circumference where they meet and made water tight. In the preferred embodiment, tube 16 is made of transparent, flexible, and collapsible plastic such as 4 mil polyethylene. However, tube 16 can consist of any other material that is flexible and collapsible such as plasticized cloth that can be cemented. Cover 18, in the preferred embodiment, is made of transparent, flexible, and collapsible plastic such as 4 mil polyethylene. Cover 18, in the preferred embodiment, is shaped like an inverted envelope (without flap) with tube 16 extending through the middle of the top of cover 18 (FIGS. 2, 3, 4, and 5). Cover 18 is approximately 112 centimeters in circumference and approximately 35 centimeters long to cover a container 24 from 10 liters to 30 liters in volume.

From the description above, a number of advantages of the shower water saver become evident:

(a) Water from the hot water tap, ordinarily wasted while waiting for the hot water to come from the hot water tank prior to showering, will be saved.

(b) The tube fits easily over different sizes of shower heads and is removed and replaced easily. Because the tube is much larger in diameter than an ordinary hose, as the water is expelled from the shower head, the high pressure is dissipated. Accordingly, a screw-in fastening able to withstand high water pressure is not needed. Thus, simple ties or a hook over the shower arm is adequate to hold the tube over the showerhead. (c) The water is protected from impurities. The invention has a convenient cover to put over a 10 liter up to a 30 liter pail or container so that a person can shower in the same space.

(d) It is an inexpensive way to save water ordinarily wasted while waiting for the warm shower to arrive. The materials needed are inexpensive and the design is easy to implement.

OPERATION OF INVENTION

Figure 8:
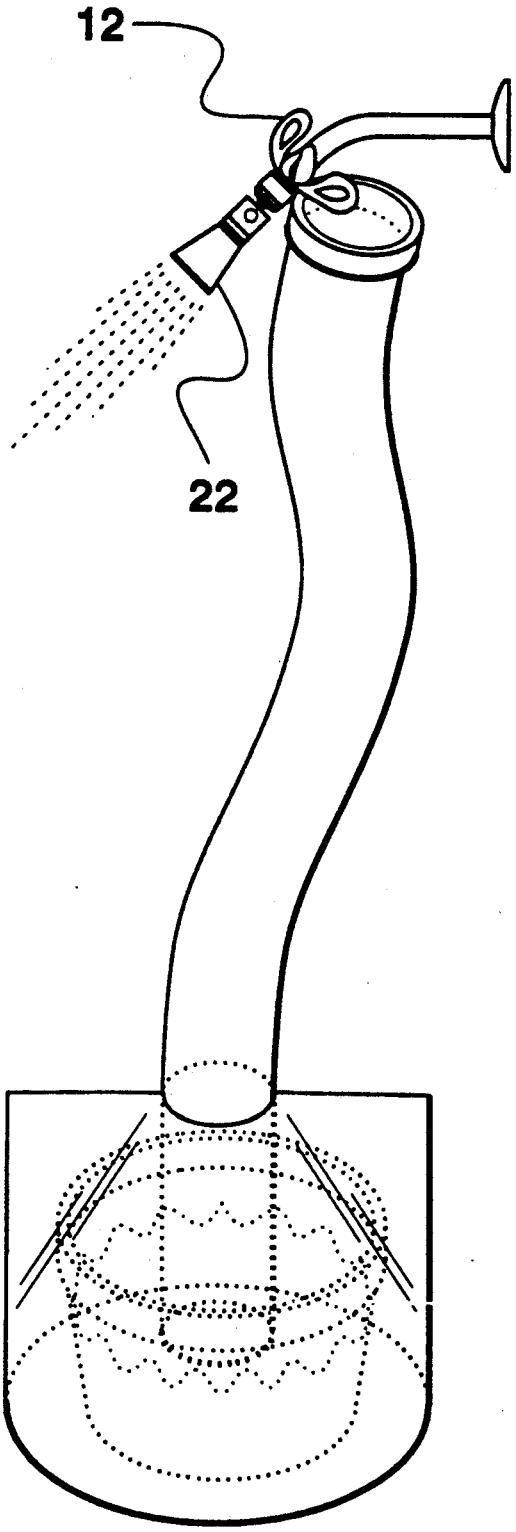
FIG. 8 is an isometric view of the invention showing cuff moved to a second position to the side of the showerhead to allow unimpaired water flow from the showerhead.

This invention involves a simple method of saving the quantity of water ordinarily wasted while waiting for the hot water to come from the hot water tank prior to showering. One first attaches fastening 12 by tying together two ties around shower arm 20 (FIGS. 6 and 7) so that cuff 14 with attached tube 16 can be placed in either of two positions: (a) Cuff 14 can surround and encase showerhead 22 and extend at a level above water discharging from showerhead 22 (FIG. 7); (b) Cuff 14 can be pulled off of showerhead 22 and hang to the side of showerhead 22 to allow unimpaired water flow from showerhead 22 (FIG. 8). Prior to running the water, place cuff 14 so that top of cuff 14 is above where water is expelled from showerhead 22 (FIG. 7). Place cover 18 over container 24 suitable for catching water (FIG. 6). Because tube 16 extends through and below cover 18, water flows directly into container 24 rather than following inner contour of cover 18 and thereby flowing outside of container 24. Next, turn on the hot side of the shower valve. One may test the water temperature by feeling the exterior of tube 16 during the waiting period. When the water is at the required temperature, slip cuff 14 down and off showerhead 22 and place cuff 14 to the side of showerhead 22 leaving cuff 14 with attached tube 16 hanging from shower arm 20 attached by fastening 12 (FIG. 8). Then use shower in usual way. Cover 18 protects the water in container 24 from contaminants while showering. When convenient, remove cover 18 from container 24 and use the water for any purpose.

SUMMARY, RAMIFICATIONS, AND SCOPE

Accordingly, the reader will see that the shower water saver of this invention can easily be stored in the shower when not in use by letting it hang from the shower arm; it can be rolled up into a compact and light package for sale or transportation; it can show how much water is being saved through its transparent tube and cover; it allows the bather to stand in the shower compartment without being sprayed with either too cold or too hot water while making the adjustments for a comfortable water temperature, and it allows the bather to determine the water heat through the tube by feeling the exterior of the tube. Furthermore, the shower water saver has the additional advantages in that:

it permits saving the water from the hot water tap ordinarily wasted while waiting for the hot water to come from the hot water tank prior to showering;

it provides a water-saving device that can easily be placed on and removed from different sizes of shower heads; because the tube is large enough to dissipate much of the water pressure, the fastening around the shower arm can be light, and the cuff can fit loosely around the showerhead allowing the user to remove and replace the shower water saver easily and conveniently.

it provides a device that protects water saved, prior to and during showering from impurities.

it provides a water saving device of a simple design and inexpensive materials that can be manufactured inexpensively and, therefore, can be economically available for almost anyone.

Although the description above contains many specificities, these should not be construed as limiting the scope of the invention but as merely providing illustrations of some of the presently preferred embodiments of this invention. For example, rather than ties, velcro, a hook or a clamp can be used to attach the tube to the shower arm. The tube can have larger or smaller dimensions and can be of other material than polyethylene such as plasticized cloth. The tube can narrow at the bottom to an inch diameter so that it can fit into the neck of a large water bottle or a can. The cuff can have a stretchable ring or an internal strap spring heatsealed within it.

Thus the scope of the invention should be determined by the appended claims and their legal equivalents, rather than by the examples given.

We claim:

1. A means for use in conjunction with a shower and a container for saving water from the shower; the shower including a showerhead having a water outlet and a shower arm, said means comprising:

a fastening means for being releasibly attached directly to the shower, an elongated flexible collapsible tube made of waterproof material, said tube being connected to said fastening means, said tube having an open upper end with a top edge and a lower end and being sufficiently large in diameter so that hydrodynamic resistance will not put undue pressure on said fastening means when said fastening means is secured to the shower, said fastening means securing said tube to said shower such that said top edge of said tube is positionable to a first position above said water outlet and so as to surround and encase the showerhead and extend to a level above the water discharging from showerhead and said tube upper end being movable to a second position above the water outlet and to the side of showerhead to allow unimpaired water flow from the showerhead; and said lower end of said tube being positionable in the container for saving water.

2. The invention of claim 1, wherein top of said tube is folded over to form a cuff thereby increasing rigidity and ability of said upper edge of said tube to extend horizontally from the shower, and the remainder of said tube is sufficiently flexible to allow a portion of said cuff to be pulled downward to clear the showerhead and placed to the side of the showerhead.

3. The invention of claim 1, further comprising a cover having a top end and depending side walls, said cover being attached to said lower end of said tube for placement of said cover over the container when said upper end of said tube is removed from around the showerhead to protect the water collected in the container, said lower end of said tube extending downwardly through the top end of said cover.

4. A method for saving water from a shower that includes a shower having a water outlet, the method comprising the steps of:

releasibly attaching a water directing device directly to the shower, the device comprising an elongated flexible tube having a top edge defining an open upper end, the upper end being selectively positionable with regard to the showerhead, the tube also having a lower end disposed in a water container, positioning the open upper end of the tube around the showerhead and above the showerhead, turning on the water for the shower, whereby water will be directed down the tube to the container, repositioning the upper end of the tube above the water outlet and away from the showerhead to allow unimpaired water flow from the showerhead.

5. Method of claim 4 including the further steps of selectively returning the upper end of tube to being positionable around the showerhead so that water is directed down the tube to the container and alternatively repositioning the upper end of the tube away from the showerhead to allow unimpaired water flow from the showerhead, repositioning as many times as necessary.

* * * * *

UNITED STATES PATENT AND TRADEMARK OFFICE

CERTIFICATE OF CORRECTION

PATENT NO. : 5,140,714

DATED : August 25, 1992

INVENTOR(S) : Aureen A. Horenstein, Stewart R. Tongret, Inez E. Tongret, June M. Adler

It is certified that error appears in the above-identified patent and that said Letters Patent is hereby corrected as shown below:

Col. 5, line 10, should be amended as shown below:

4. A method for saving water from a shower that includes a [shower] <u>showerhead</u> having a water outlet, the method comprising the steps of:

Signed and Sealed this

Twenty-seventh Day of April, 1993

*Attest:*

MICHAEL K. KIRK

*Attesting Officer*

*Acting Commissioner of Patents and Trademarks*